US009878230B1

(12) United States Patent
Seele

(10) Patent No.: US 9,878,230 B1
(45) Date of Patent: Jan. 30, 2018

(54) CONCEALED COMPARTMENT SYSTEM FOR A SKATEBOARD

(71) Applicant: Kevin Seele, San Diego, CA (US)

(72) Inventor: Kevin Seele, San Diego, CA (US)

( * ) Notice: Subject to any disclaimer, the term of this patent is extended or adjusted under 35 U.S.C. 154(b) by 51 days.

(21) Appl. No.: 15/051,507

(22) Filed: Feb. 23, 2016

Related U.S. Application Data

(60) Provisional application No. 62/120,498, filed on Feb. 25, 2015.

(51) Int. Cl.
*A63C 17/26* (2006.01)
*A63C 17/01* (2006.01)

(52) U.S. Cl.
CPC ..... *A63C 17/26* (2013.01); *A63C 17/012* (2013.01)

(58) Field of Classification Search
CPC ..... A63C 17/26; A63C 17/012; A63C 17/017; A63C 17/0006; A63B 3/0031; A43B 5/1641
See application file for complete search history.

(56) References Cited

U.S. PATENT DOCUMENTS 4,773,239 A 9/1988 Lowe et al.
4,824,139 A * 4/1989 Robbins ..... A63C 17/26 280/816
4,886,297 A * 12/1989 Levine ..... A63C 17/0006 16/422
5,005,868 A * 4/1991 Stern ..... A63C 17/0006 224/162
5,119,277 A * 6/1992 Copley ..... A63C 17/26 280/87.042
5,921,653 A * 7/1999 Chien ..... A43B 1/0036 280/811
6,230,526 B1 * 5/2001 Fontes ..... A63C 11/004 280/809
6,279,434 B1 8/2001 Brown
6,289,612 B1 * 9/2001 Kent ..... A43B 3/00 36/132
6,374,645 B1 * 4/2002 Fontes ..... A63C 11/004 280/809
6,450,659 B1 * 9/2002 Salatino ..... A63C 17/06 280/11.19
6,621,419 B2 * 9/2003 Chiu ..... A63C 17/26 280/11.19
6,646,547 B2 * 11/2003 Chiu ..... G08B 5/004 280/87.042
6,802,636 B1 * 10/2004 Bailey, Jr. ..... A63C 17/01 280/841
6,828,916 B2 * 12/2004 Rains ..... A63C 17/01 340/384.1

(Continued)

FOREIGN PATENT DOCUMENTS

DE 202011104047 U1 * 10/2011 ..... A63C 17/0093
WO WO 0076600 A2 * 12/2000 ..... A63C 17/0006

*Primary Examiner* — James A Shriver, II
*Assistant Examiner* — Steve Clemmons
(74) *Attorney, Agent, or Firm* — Advantage IP Law Firm

(57) ABSTRACT

A concealed compartment system for use with a skateboard is provided by a riser with a rail body having a deck mounting surface and a truck mounting surface with the riser acting as a spacer between the skateboard deck and at least one truck when assembled together, the riser further including a channel projecting at least partially through the rail body in which one or more items may be stored.

18 Claims, 19 Drawing Sheets

(56) References Cited

U.S. PATENT DOCUMENTS

| | | | | |
|---|---|---|---|---|
| 7,007,977 | B1 * | 3/2006 | Gallagher | A63C 17/26 280/11.27 |
| 8,317,206 | B1 | 11/2012 | Novitzky et al. | |
| D697,570 | S | 1/2014 | Samuels | |
| 8,752,746 | B2 | 6/2014 | Dee | |
| 8,827,286 | B2 | 9/2014 | Woncik | |
| 8,870,475 | B1 | 10/2014 | Bennett et al. | |
| D719,628 | S | 12/2014 | Samuels | |
| 9,285,241 | B2 * | 3/2016 | Rogel | H04R 1/02 |
| 9,604,125 | B2 * | 3/2017 | Page | A63C 17/26 |
| 2003/0185019 | A1 * | 10/2003 | Rogers | A63C 17/0093 362/545 |
| 2003/0201620 | A1 * | 10/2003 | Seelye | A63C 17/01 280/87.042 |
| 2004/0100055 | A1 * | 5/2004 | Chang | A63C 17/01 280/87.042 |
| 2005/0030746 | A1 * | 2/2005 | Goode | A63C 17/26 362/253 |
| 2008/0036165 | A1 * | 2/2008 | Reinson | A63C 17/01 280/87.042 |
| 2008/0042387 | A1 | 2/2008 | Lesko | |
| 2009/0236811 | A1 * | 9/2009 | Lewis | A63C 17/0093 280/87.042 |
| 2012/0039483 | A1 | 2/2012 | Burke et al. | |
| 2013/0305790 | A1 | 11/2013 | Seele | |
| 2014/0265200 | A1 * | 9/2014 | Signorelli | A63C 17/0006 280/87.042 |
| 2016/0195246 | A1 * | 7/2016 | Carattini | A63C 17/26 362/486 |

* cited by examiner

CONCEALED COMPARTMENT SYSTEM FOR A SKATEBOARD

CROSS-REFERENCE TO OTHER APPLICATIONS

This application claims the benefit of U.S. Application No. 62/120,498, filed on Feb. 25, 2015, entitled the same, and which is hereby incorporated by reference in its entirety.

BACKGROUND OF THE INVENTION

1. Field of the Invention

The present invention relates to skateboards, and more particularly, to skateboards incorporating a storage feature.

2. Background Art

It is well known that skateboard components require adjustments or repairs during frequent use. Whether it's tightening the trucks, replacing a bearing set, or replacing a wheel, the rider often winds up well away from a repair center, such as their own garage, with a skateboard having an adjustment or repair need. Thus, it's commonplace to carry a set of repair tools in a pocket or backpack so they are available when needed. Other handy items may also be needed when out riding around, including food, money, keys, credit cards, cell phone, GPS units, video recording cameras, and other relatively low profile items. While it is somewhat convenient to carry such items around on one's person or in a pack or wallet, today's conventional skateboard construction lacks for any significant storage capacity. Thus, the market is missing out on a relatively unexplored opportunity.

One such attempt may be found in U.S. Pat. No. 8,317,206 to Novitzky et al. which describes a skateboard built similar to a briefcase with wheels in that the main deck is enlarged to form a storage compartment with a hinged lid. Since the storage capacity is similar to a briefcase due to the size of the storage compartment, the overall weight of the skateboard is increased considerably, especially when a number of items are stored therein. For example, the illustrations depict school supplies stored in the storage compartment. This adds significantly to the overall weight of the skateboard and provides much more storage than is typically necessary. The briefcase type construction also unnecessarily complicates the manufacturing process of the skateboard due the need for a hollow core, lid, storage compartment, hinges, and latches to secure the lid. A built in handle and/or recessable trucks and wheel sets further complicates the construction. More importantly, the riding characteristics are compromised given the enlarged hollow core covered by a hinged lid instead of the conventional single board deck or multiple laminate construction. The materials stored inside the compartment are also prone to shifting during use further negatively impacting the riding characteristics of the skateboard.

Another example may be found in U.S. Patent Application Publication No. 2008/0042387 to Lesko. In that publication, a single-handed lifting skateboard is described. In particular, the skateboard deck includes a set of gripping apertures about the periphery of the deck at four spaced apart end or side positions for carrying the skateboard. In one embodiment, an insert may be located within an aperture and provided with a hollow core for storing a key. While this provide a somewhat satisfactory solution, the insert may easily be dislodged in use or require removal prior to handling the gripping aperture to carry the skateboard. In addition, the incorporation of an insert within the deck of the skateboard may introduce unnecessary structural weaknesses into the deck that increase the likelihood of cracking or splitting the deck in use.

Given the drawbacks of the current technology, there exists a need for a concealed compartment that generally blends with the conventional skateboard construction while enhancing the overall riding experience.

SUMMARY OF THE INVENTION

In accordance with the principles of the present invention, a concealed compartment system for a skateboard having a skateboard deck and at least one truck is provided with a riser having a rail body with a deck mounting surface and a truck mounting surface, the riser being constructed to be at least partially interposed between the skateboard deck and at least one truck while releasably securing the at least one truck to the skateboard deck, the riser further including a channel projecting at least partially through the rail body in which one or more items may be stored.

In another embodiment, the channel includes a storage compartment with a storage chamber or a drawer that may be at least partially inserted into the channel of the rail body.

In yet another embodiment, the rail body includes a set of spaced apart rails defining the channel in which the storage compartment may be loaded.

Another feature of the present invention is the introduction of a concealed compartment opening.

In yet another embodiment, at least one riser includes a locking component that may be used to secure the skateboard deck to a fixed object.

Other aspects of the present invention include the incorporation of interchangeable cartridge inserts with installed devices such as an LED, battery charger, GPS unit, charging port, toolkit, locking tethers, and other useful skateboard activity items.

Another feature of the present invention is the introduction of a camera mount for securing a camera to the skateboard for capturing videos of the riding experience.

All of the embodiments summarized above are intended to be within the scope of the invention herein disclosed. However, despite the discussion of certain embodiments herein, only the appended claims (and not the present summary) are intended to define the invention. The summarized embodiments, and other embodiments and aspects of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENTS

Referring now to FIGS. 1-7, a first embodiment of a pair of front and rear concealed compartment systems, generally designated 30*a*, 30*b*, is provided for use with a skateboard, such as an exemplary skateboard 32 (FIG. 1) having a front end (nose) 33 and a rear end (tail) 35 (depending on direction of travel) and allows a user to store one or more items in a storage compartment that blends well with the remaining skateboard construction while preferably not compromising the deck construction and enhancing the ride experience similar to a skateboard incorporating a riser.

In this first embodiment as depicted in FIGS. 1-7, the concealed compartment systems 30*a*, 30*b* are disposed between the bottom surface 34 of the skateboard deck 36 and the top surface 38*a*, 38*b* of the corresponding front and rear skateboard trucks 40*a*, 40*b*. As the concealed compartment systems 30*a*, 30*b* are constructed in identical fashion in this exemplary embodiment and merely facing in opposite directions beneath their respective front and rear trucks, a single representative concealed compartment system 30*a* will now be described with the understanding that the concealed compartment system 30*b* is constructed the same and merely mounted to face in the opposite direction in this first embodiment.

Figure 1:
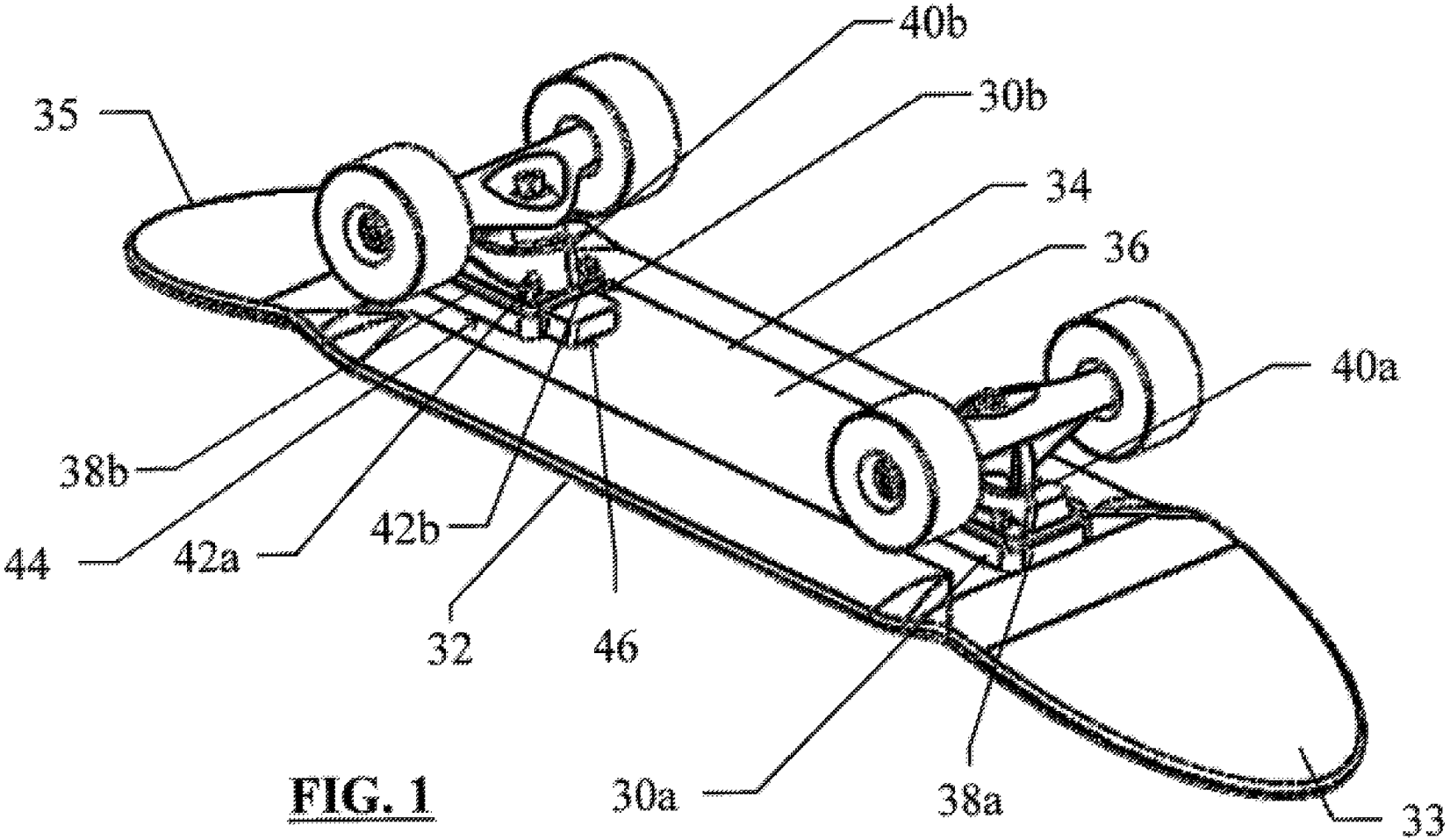
FIG. 1 is a bottom side perspective view of an exemplary first embodiment of a concealed compartment system for use with a skateboard constructed in accordance with the principles of the present invention.

Still referring to FIGS. 1-7, typically, there are four bolts to a truck and two trucks 40*a*, 40*b* mounted on the bottom surface 34 of a skateboard deck 36. Two of the four bolts 42*a-b* are shown in FIG. 1 with the rearmost two bolts concealed by the axle and wheels. The truck mounting bolts fastening the skateboard truck to the skateboard deck are generally sized to accommodate the truck mount thickness and to secure the truck to the deck. Since the introduction of the concealed compartment system 30*a* introduces an additional thickness to the overall truck and deck assembly, the four bolts supplied with the skateboard may need to be replaced with longer versions to accommodate the additional thickness of the concealed compartment system. However, this is well within the skill level of one of ordinary skill in the art and is similar to selecting bolt lengths for a conventional skateboard riser insert or riser pad.

Figure 4:
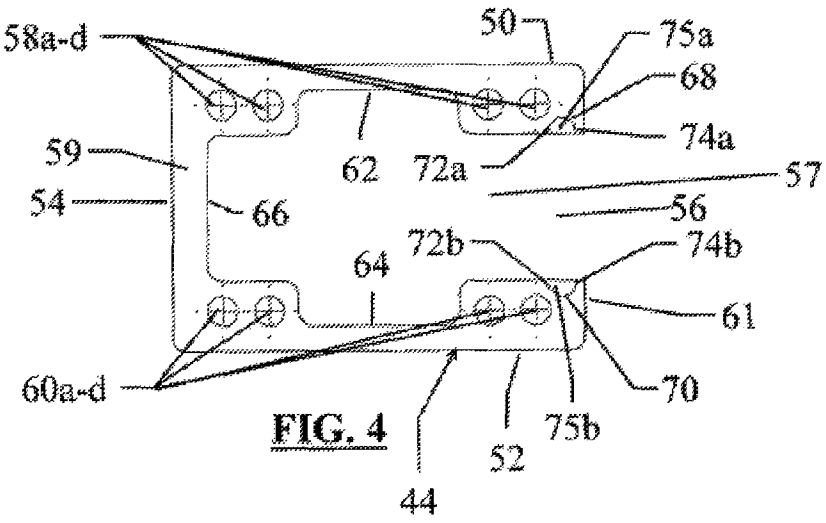
FIG. 4 is a top view of the rail body of the concealed compartment system from FIG. 2.

Referring now to FIGS. 2-6, in general, the concealed compartment system 30*a* includes a rail body 44 (FIGS. 2-4) and a slidably engaged cartridge insert 46 (FIGS. 3, 5A-6) with a storage chamber 48 disposed between the upper surface 38*a* (FIG. 1) of the truck 40*a* and the bottom surface 34 of the deck 36. Overall, the concealed compartment system 30*a* generally behaves like a riser spacing the corresponding truck from the bottom surface of the deck and does not compromise the existing deck construction. In this first exemplary embodiment, the rail body 44 of the concealed compartment system 30*a* is generally C-shaped with a pair of spaced apart opposing rails 50, 52 connected by a rear cross beam 54. At the opposite outer end 61 of the rail body from the cross beam, an opening 56 is provided for receiving the cartridge insert 46 between the opposing rails 50, 52 within an insert slot 57 or channel. Each rail, 50, 52 incorporates a set of four throughbores 58*a-d* and 60 *a-d*, respectively, for inserting the truck bolts and mounting the rail body between the truck and bottom surface 34 of the deck 36. While only two throughbores for each rail 50, 52 are typically needed for each mounting of the rail body to the skateboard deck 36, the use of four throughbores per rail 50, 52 is provided to accommodate different truck bolt hole spacing providing an extra level of adaptability to different skateboard deck configurations. Such throughbores may also be custom-located based on the matching holes in the selected truck and deck set. The uppermost surface 59 (side that abuts the bottom surface 34 of the deck 36) of the rail body 44 is shown in FIG. 4. The opposite bottom side of the rail body 44 is identical and the rail body may easily be reversed during installation to mount the cartridge facing up or down as selected, although the preferred configuration is with the compartment 48 facing upwardly toward the bottom surface 34 of the deck 36. Each rail 50, 52 further includes a central recess 62, 64, respectively, with a third recess 66 formed between the rails for housing at least a portion of the cartridge insert 46 and forming the closed end of the insert slot 57 as defined by the cross beam 54. Alternatively, as described below in other exemplary embodiments, the rail (or block) body may omit the cross beam 54 and present a configuration with opposing open ends such as that shown in FIGS. 15 and 28.

Still referring to FIG. 4, the end of each rail 50, 52 proximate the opening 56 includes an inwardly facing catch recess 68, 70, respectively. Each catch recess 68, 70 includes an inner curved section 72*a*, 72*b* transitioning to a more planar section 74*a*, 74*b* that acts as a catch that interacts with the cartridge insert 46 as described below. In this exemplary embodiment, the recesses 68, 70 do not pass completely through each rail and terminate in a lowermost ledge 75*a*, 75*b*, respectively. While these ledges may assist in aligning or securing the cartridge insert 46 in use, they are optional. If omitted, then the rail body may be mounted either side face up and used with the cartridge insert face up or face down. Use of these ledges, on the other hand, dictates the direction of the storage compartment 48 relative to the direction that the rail body is mounted between the truck and deck.

Figure 6:
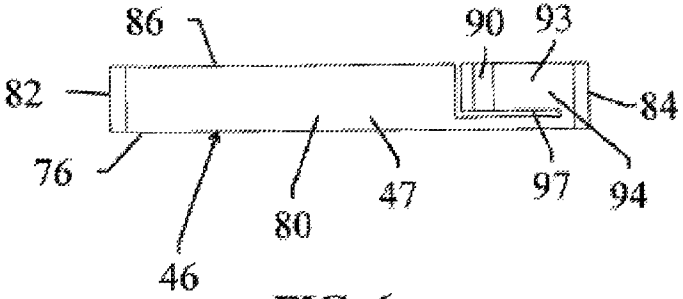
FIG. 6 is a side view of the cartridge insert of FIG. 5A.
Figure 5A:
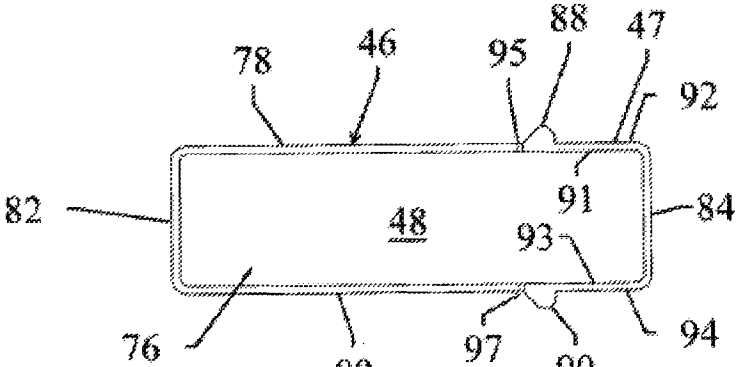
FIG. 5A is a top view of the cartridge insert of FIG. 3.
Figure 7:
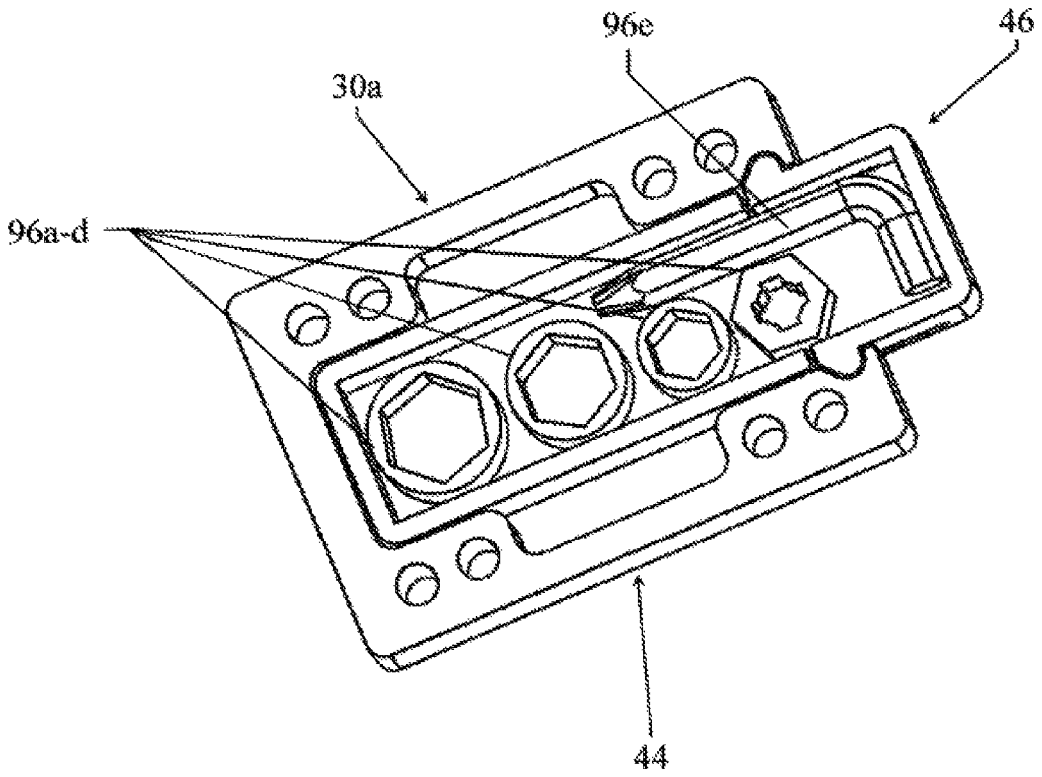
FIG. 7 is a top view of the concealed compartment system of FIG. 3, in enlarged scale, with an exemplary repair kit stored therein.

Referring now to FIGS. 5A-6, the cartridge insert 46 includes a cartridge insert body 47 with an elongated storage chamber 48 with base 76 and four side walls 78, 80, 82, and 84 and an open top section 86. Extending outwardly from the two sidewalls 78, 80 are a pair of bosses 88, 90 that are constructed with a complementary shape to the catch recesses 68, 70 of the rail body 44. The bosses 88, 90 are located at the end of a flexible tang 91, 93, respectively, that are partially separated from the cartridge insert body 47 by an L-shaped slot 95, 97, respectively. The slots 95, 97 allow their respective tangs 91, 93 to flex inwardly as the cartridge insert 46 is slid into the cartridge insert slot 57 between the rails 50, 52 so that the bosses 88, 90 engage their respective catch recesses 68, 70. The tangs are sufficiently resilient to flex inwardly to slip past the ends of the rails 50, 52 and then flex outwardly to engage the respective catch recesses 68, 70 and do the reverse when the cartridge insert 46 is withdrawn from the rail body 44. When installed, a portion of the outer end of the cartridge insert 46 may extend outside the rail body 44 to provide opposing grasping surfaces 92, 94 for purchase of the insert and facilitate loading and extraction of the cartridge insert relative to the rail body. In general, the cartridge insert 46 slidably engages the rails 50, 52 of the rail body 44 and is held in place by the boss/catch recess engagement until the user pulls, withdraws, or otherwise frees the cartridge insert from the rail body. A handle could also extend from the outer wall 84 of the cartridge insert 46 to facilitate withdrawal.

An illustrative size for the rail body 44 in this exemplary embodiment is 83.5 mm long and 57.275 mm wide. The depth of the central slot 57 from the opening 56 to the cross beam 54 is 76.5 mm. Each rail recess 62, 64, is 9 mm deep. An illustrative size for the cartridge insert is 92.25 mm long and 28.275 mm with the storage compartment depth 11-12 mm deep. The bosses 88, 90 are positioned 15-20 mm from the outer end 84 of the cartridge insert 46 and are positioned to register with their respective catch recesses 68, 70 when the cartridge insert 46 is fully inserted into the cartridge insert slot 57. The overall depth of the cartridge insert will not exceed the thickness of the rail body 44 unless the truck and/or deck surfaces accommodate the extra thickness. These dimensions are exemplary and not meant to be limiting in any manner.

Materials:

The rail body 44 and insert 46 are preferably made of a durable plastic material, although other suitable materials including metal, and wood, or a combination thereof may be used. It is also contemplated that the insert may be made from a suitable textile and has a zipper or snap opening. The cloth would preferably have a rigid backing to facilitate insertion through the rail body. The embodiments described herein may be used with any conventional skateboard deck and truck sets as well. The device may be manufactured using conventional molding, casting, pressing, printing, forming, or machining techniques or other suitable construction method.

In Use:

Referring to FIGS. 1-7, to install the rail body 44, the user may simply unscrew the truck bolts 42*a-b* (and those bolts concealed from view in FIG. 1) from the corresponding truck 40*a* to remove the truck from the bottom surface 34 of the skateboard deck 36. The rail body may then be placed against the bottom surface 34 of the deck 36 with a subset of throughbores 58*a-d* and 60*a-d* aligned with the bolt holes in the deck. The truck is then replaced with its respective bolt holes aligned with the selected throughbores of the rail body. The bolts are then threaded back into the truck and rail body and into the deck and secured conventionally. As noted above, longer bolts may be required to accommodate the additional thickness of the rail body.

In this exemplary embodiment, it will be appreciated that the rail body 44 is reversible and may be mounted with either the top surface or the identical bottom surface 59 against the bottom surface 34 of the deck. In this exemplary embodiment, the rail body 44 is disposed with its opening 56 (and thus the grasping surfaces 92, 94 of the cartridge insert 46 when installed) facing toward the central transverse axis of the skateboard deck, that is, facing the opposing truck and wheel set. However, the rail body may be mounted to face in the opposite direction as well, given the preference of the user.

The user may then slide the inner end 82 of the cartridge insert 46 between the rails 50, 52 and into the central cartridge insert slot 57 through the opening 56. As the user continues to push the cartridge insert between the rails, the bosses 88, 90 will encounter the outer end 61 of the rail body. At this point, as the user continues to push or drive the cartridge insert 46 between the rails 50, 52, the interaction between the bosses 88, 90 on the end of their respective flexible tangs 91, 93 of the cartridge insert 46 and the interior surface of the rails 50, 52 will flex the respective tangs 91, 93 inwardly until the bosses are registered with their respective catch recesses 68, 70. As the bosses begin to register with the corresponding catch recesses, the resilient tangs will drive the bosses into the corresponding catch recess to fully engage the boss with the catch recess on each side of the cartridge insert and juxtaposed rail body inner surface. When the bosses are engaged with the catch recesses, the rear wall 82 of the cartridge insert body 47 generally abuts the interior surface of the cross beam 54 within the cross beam recess 66 or is disposed in close proximity thereto.

With the bosses 88, 90 snapped into and otherwise engaging the corresponding catch recesses 68, 70, the cartridge insert 46 is releasably locked or secured to the rail body 44. At this point, the concealed compartment 48 is closed off between the base 76 and side walls 78, 80, 82, 84 of the cartridge insert 46 and the bottom surface 34 of the deck 36. To extract the cartridge insert 46, the user may simply grasp the grasping surfaces 92, 94 of the cartridge insert and use enough force to flex the tangs 91, 93 inwardly to disengage the bosses 88, 90 from the catch recesses 68, 70. The user may then add items within the confines of the insert defined by the base 76 and four side walls 78, 80, 82, 84 and then reinsert the cartridge insert into the rail body 44 to store the items. Examples of storage items 96*a-e* may include hex wrenches, replacement parts such as nuts and bolts, such as those shown in FIG. 7, and/or personal items such as credit cards, cash, and keys. Other suitable items will occur to the user.

It will be appreciated that the concealed compartment systems 30*a*, 30*b* merely act as a riser or spacer between the truck and skateboard deck and may improve the steering and riding experience of the user similar to the behavior introduced by a riser. It will also be appreciated that the deck remains intact and is not altered in any manner with the only potential modification being truck bolt length to accommodate the thickness of the concealed compartment system. It will further be appreciated that a pair of concealed compartment systems 30*a*, 30*b* is disclosed in this first embodiment. However, only one concealed compartment system may be used with the front or rear truck with the other truck incorporating a conventional riser with matching thickness or other desired truck profile as will occur to the user. In addition, the concealed compartment systems 30*a*, 30*b* may be oriented in the same or opposite directions.

Figure 8:
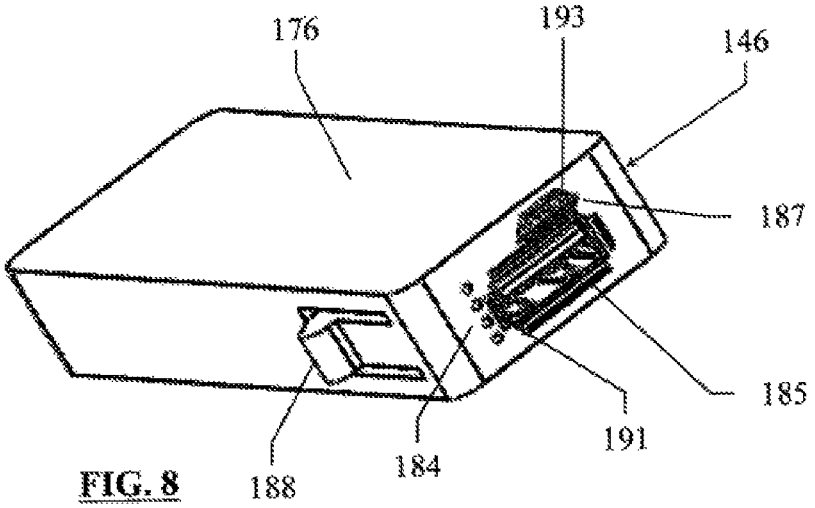
FIG. 8 is a bottom forward perspective view of an exemplary alternative cartridge insert for use with the concealed compartment system in accordance with the principles of the present invention.
Figure 9:
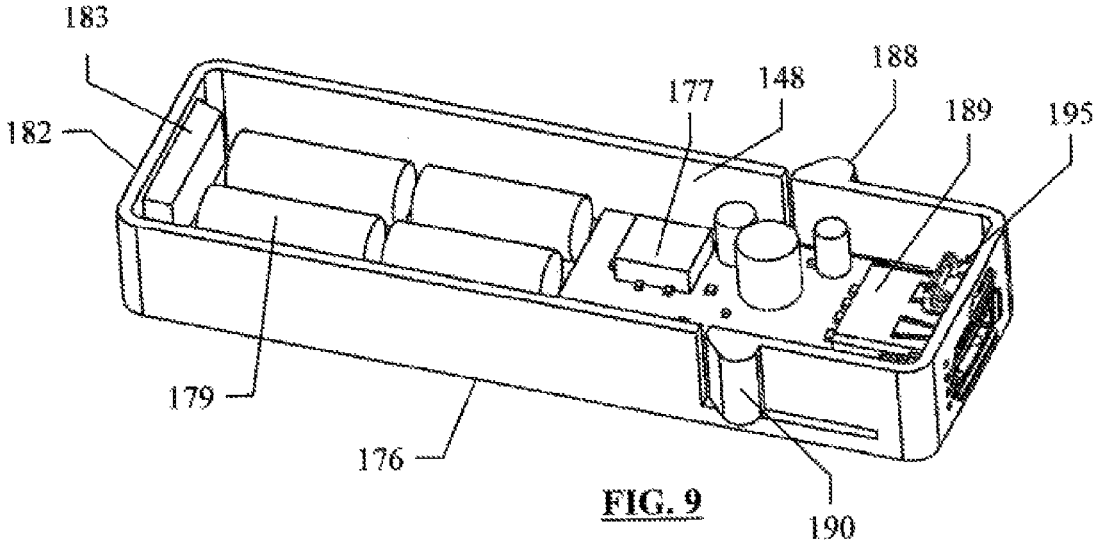
FIG. 9 is a top forward perspective view of the cartridge insert of FIG. 8, in enlarged scale.
Figure 10:
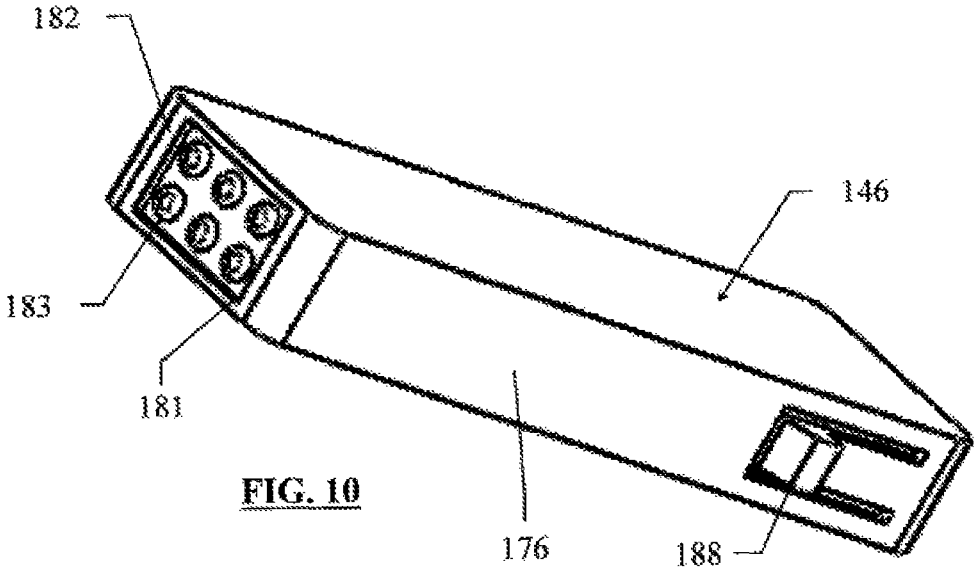
FIG. 10 is a bottom rear perspective view of the cartridge insert of FIG. 8, in enlarged scale.

Alternative Cartridge Inserts:

Turning now to FIGS. 8-10, an alternative cartridge insert containing electronic components, and generally designated 146, is shown. It will be appreciated that such insert 146 may be used with the rail body 44 of FIGS. 1-7 (or open rail variations 544 as, for example, in FIG. 15) and used in a similar manner. For the most part, this cartridge insert 146 is constructed identically to the cartridge insert 46 and like components are numbered alike. For example, the bottom surface 176 of the cartridge insert 146 is similar to the bottom surface 76 of the cartridge insert 46 of FIGS. 5B and 6 and the bosses 188, 190 are similar to the bosses 88, 90 of FIG. 5A. The main change in construction relative to the prior cartridge insert 46 is that an outer end wall 184 is modified to include a pair of openings for a USB port 185 and a charging port 187. The interior chamber 148 includes a USB adapter 189 with its opening 191 inserted into and secured to the USB port 185. A charging adapter 195 is aligned with its opening 193 inserted into and secured to the charging port. A mobile device charger 177 in the form of a circuit board coupled to a battery source or pack 179 may be inserted into the chamber 148 and plugged into or placed in communication with the interior side of the adapters. Thus, the user may either plug a mobile device, such as a smartphone, GPS device, cell phone, audio player, or video camera, for example, into the cartridge insert 146 situated within the rail body 44 or remove the cartridge insert 146 and plug the adapters into the mobile device to charge the device. If the mobile charging device is too large for the selected cartridge insert, the casing of the mobile charging device may have to be modified. Alternatively, a removable mobile charging device may simply be placed within the compartment 148 and removed when needed to plug into the user's mobile device without the need for modifying the outer end wall 184.

Referring now to FIG. 10, in addition to the internal mobile device charging device (177 and 179 together with the adapters 189, 195), the cartridge insert 146 may also include an optional light source in the interior end wall 182 in the form of an LED array 183 connected to the interior power source 179 coupled to the LED array 183 to power up the LED array. A switch (not shown) turns the LED array on or off. Alternatively, the LED array may be a self-contained rechargeable unit that may be charged elsewhere and inserted into the storage compartment 148 of the cartridge insert 146 in place of the mobile charging device with the LED array disposed within an opening 181 in the interior end wall 182 (or other side wall). The LED unit may switched on, inserted into the cartridge insert with the LED array registered with the opening 181 of the cartridge insert, and the cartridge insert inserted into the rail body to use as a light when riding at night. This may also provide a safety feature for rider's at night by alerting vehicle drivers of the skateboarder's presence. Alternatively, a GPS device with a user interface may be inserted into the storage compartment 48 for use with the concealed compartment system. One of the walls of the cartridge insert may be modified to expose a user interface screen of the GPS unit for viewing speed, time and distance, and other riding related metrics. When using a transparent skateboard deck, the GPS unit interface screen may face upwards so that the rider may view the screen while riding through the deck. Alternatively, the GPS unit may simply be retrieved from the storage compartment and viewed conventionally.

Figure 11:
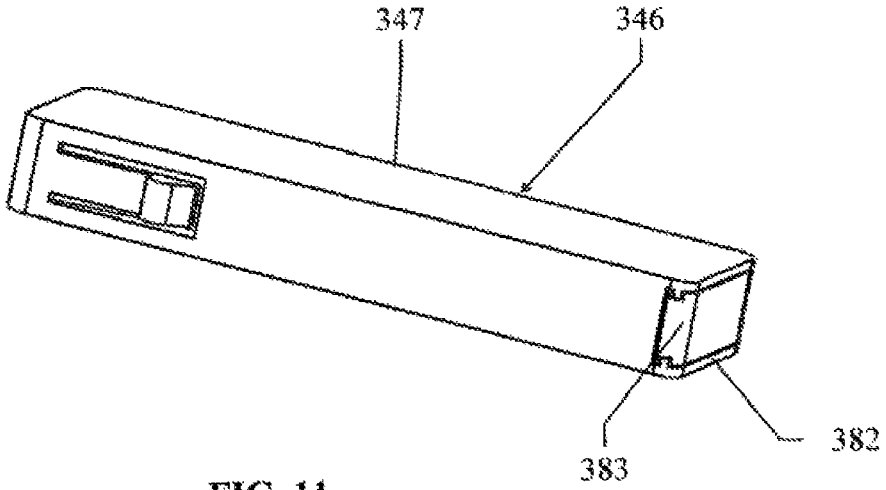
FIG. 11 is an upper front side perspective view of another exemplary cartridge insert with a flip open cover for use with the concealed compartment system in accordance with the principles of the present invention.
Figure 12:
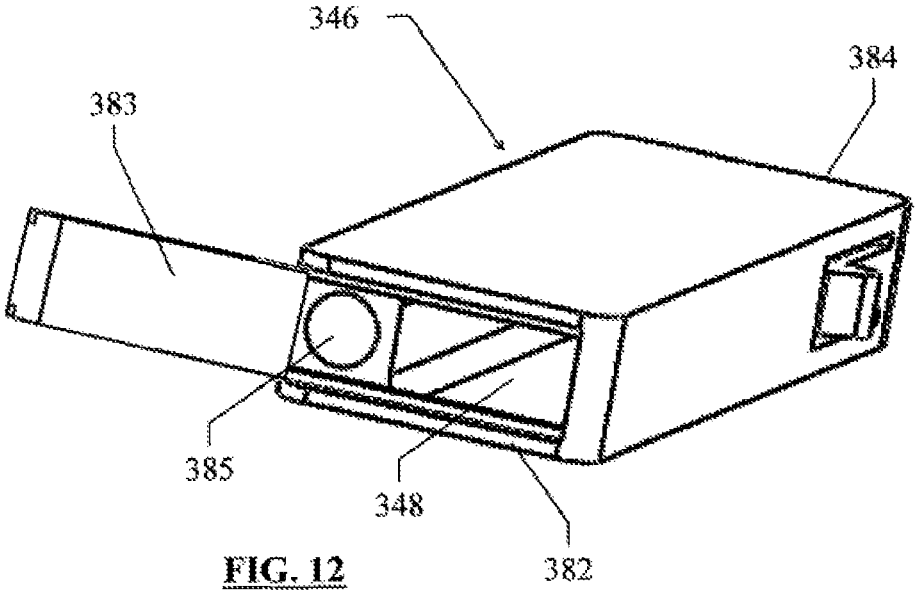
FIG. 12 is a similar view to FIG. 11, in enlarged scale, with the cover flipped open.

Referring now to FIGS. 11-12, another cartridge insert alternative, generally designated 346 is shown. This insert may be used with the rail body 44 of FIGS. 1-7 and used in a similar manner. For the most part, this cartridge insert 346 is constructed identically to the cartridge insert 46 and like components are numbered alike. The main change in construction is that the inner end 382 has a flip open door 383 that may be slid off the cartridge insert body 347 to expose and provide access to the interior storage compartment 348. The 382 end is further modified with an insert 385 to provide a sub-divided storage chamber 387 for storing items separately. In this exemplary embodiment, the second chamber 387 is constructed for storing a cylindrical object apart from the main chamber 348. Instead of flipping open the door 383 off the cartridge insert body 347, the door may be slidably connected to the cartridge insert body and simply slid open to access the storage chambers 348, 387 and slid closed to conceal the chambers. As another alternative, the second chamber 387 may be inaccessible from the opposing end 384 and thus form a secret compartment only accessible from the inner end 382 of the cartridge insert.

Figure 2:
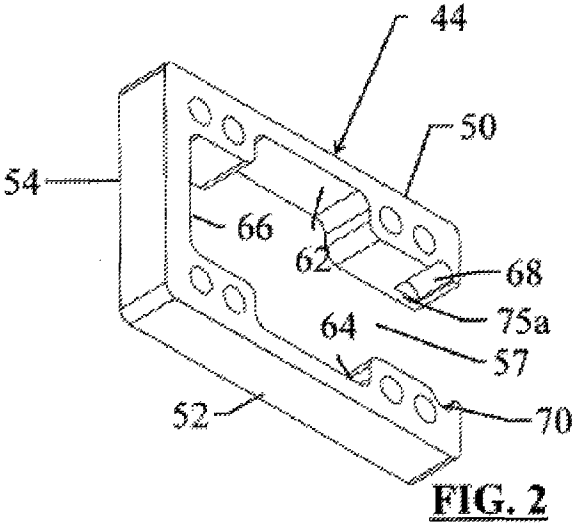
FIG. 2 is an upper perspective view, in enlarged scale, of an exemplary rail body of the concealed compartment system from FIG. 1 with a cartridge insert removed.
Figure 3:
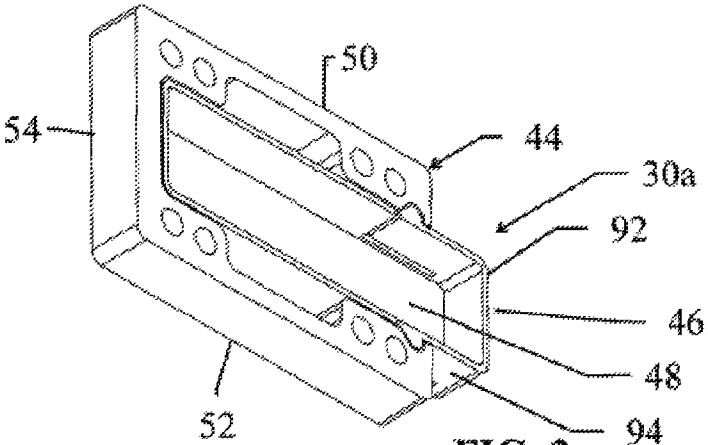
FIG. 3 is a similar view to FIG. 2 with an exemplary cartridge insert included.
Figure 5B:
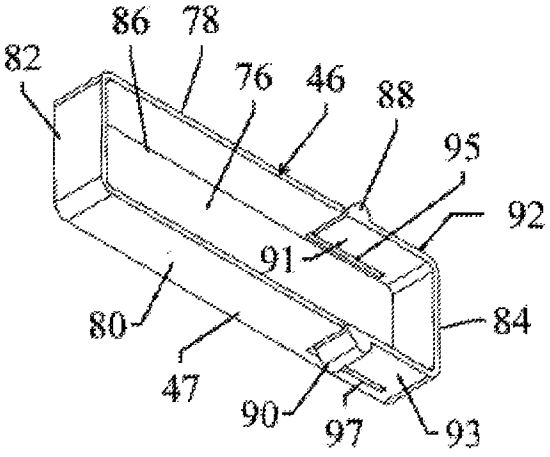
FIG. 5B is a similar view to FIG. 3 with the rail body removed.
Figure 24:
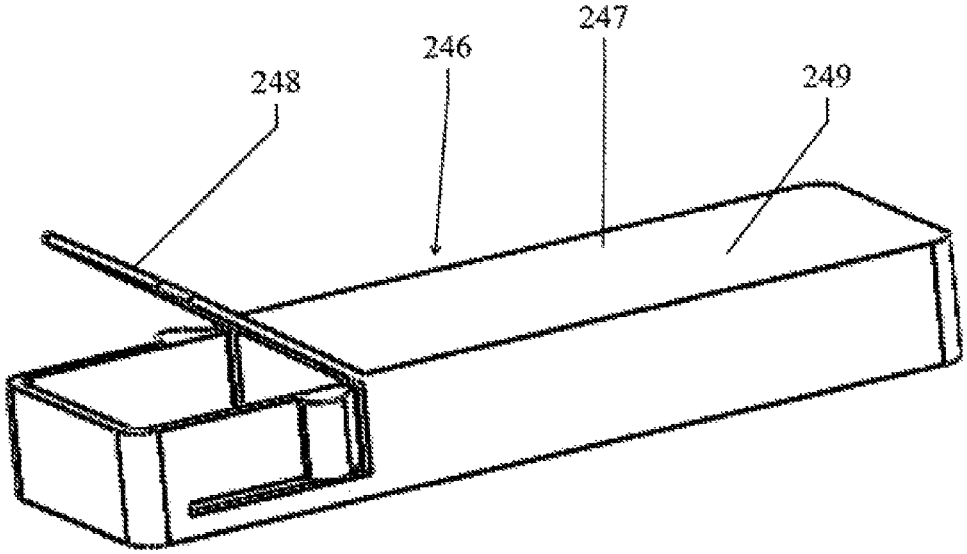
FIG. 24 is an upper perspective view of another exemplary cartridge insert with a flip open cover for use with the concealed compartment system in accordance with the principles of the present invention.

Referring now to FIG. 24, another alternative cartridge insert generally designated 246, is shown. For the most part, this cartridge insert 246 is constructed identically to the cartridge insert 46 and like components are numbered alike. However, this cartridge insert includes a closed off upper surface 247 with a shortened portion 248 of the upper surface hingedly coupled to the remaining portion 249. The upper surface generally abuts the undersurface 34 of the skateboard deck 36 when installed between the rail body 44 (FIG. 2).

Figure 13:
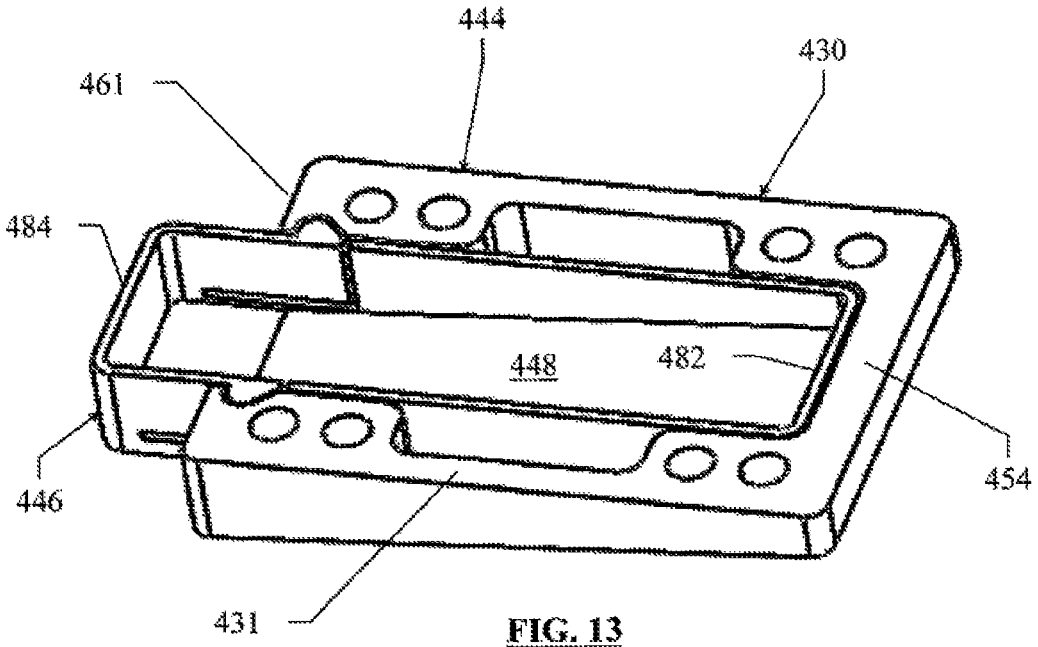
FIG. 13 is a perspective side view of an exemplary second embodiment of a concealed compartment system for use with a skateboard constructed in accordance with the principles of the present invention.
Figure 14:
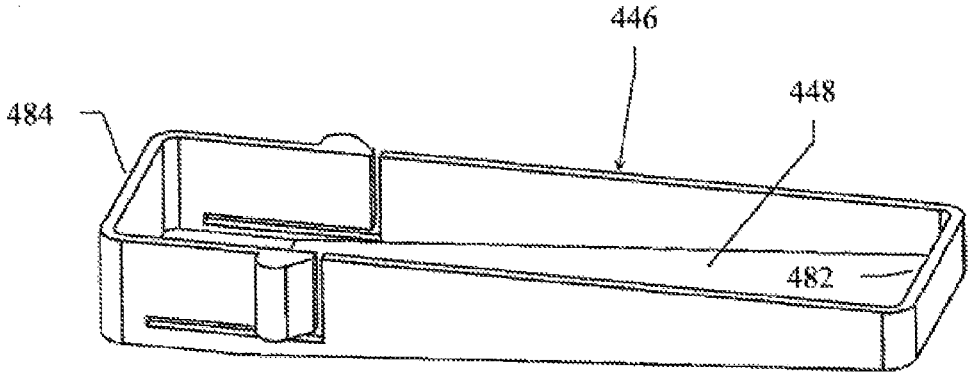
FIG. 14 is a similar view to FIG. 13, in enlarged scale, with the rail body removed.

Alternative Concealed Compartment Systems:

Turning now to FIGS. 13-14, a second embodiment of the concealed compartment system, generally designated 430, is illustrated, wherein like components are numbered alike. In this wedge-shaped concealed compartment system 430, the upper surface 431 of the assembled rail body 444 and the cartridge insert 446 are tapered from the cross beam end 454 to an enlarged slot end 461 with the outermost end 484 of the cartridge insert 446 presenting the largest profile as viewed in FIG. 14. This provides a storage compartment 448 that is deeper at the outer end 484 than the inner end 482. Overall, this concealed compartment system 430 may be used to replace a wedge-shaped or angled riser. Except for the angled cut of the concealed compartment system 430, the construction and operation of this embodiment is identical to that of the first embodiment 30 described above. It will be appreciated that the angular profile of the concealed compartment system 430 may provide a modified turning radius (typically for sharper turns) due to the change in angle of the truck kingpin similar to the functionality of a wedge-shaped riser. The truck angles may also be altered in accordance with the wedge profile of the concealed compartment system.

Figure 15:
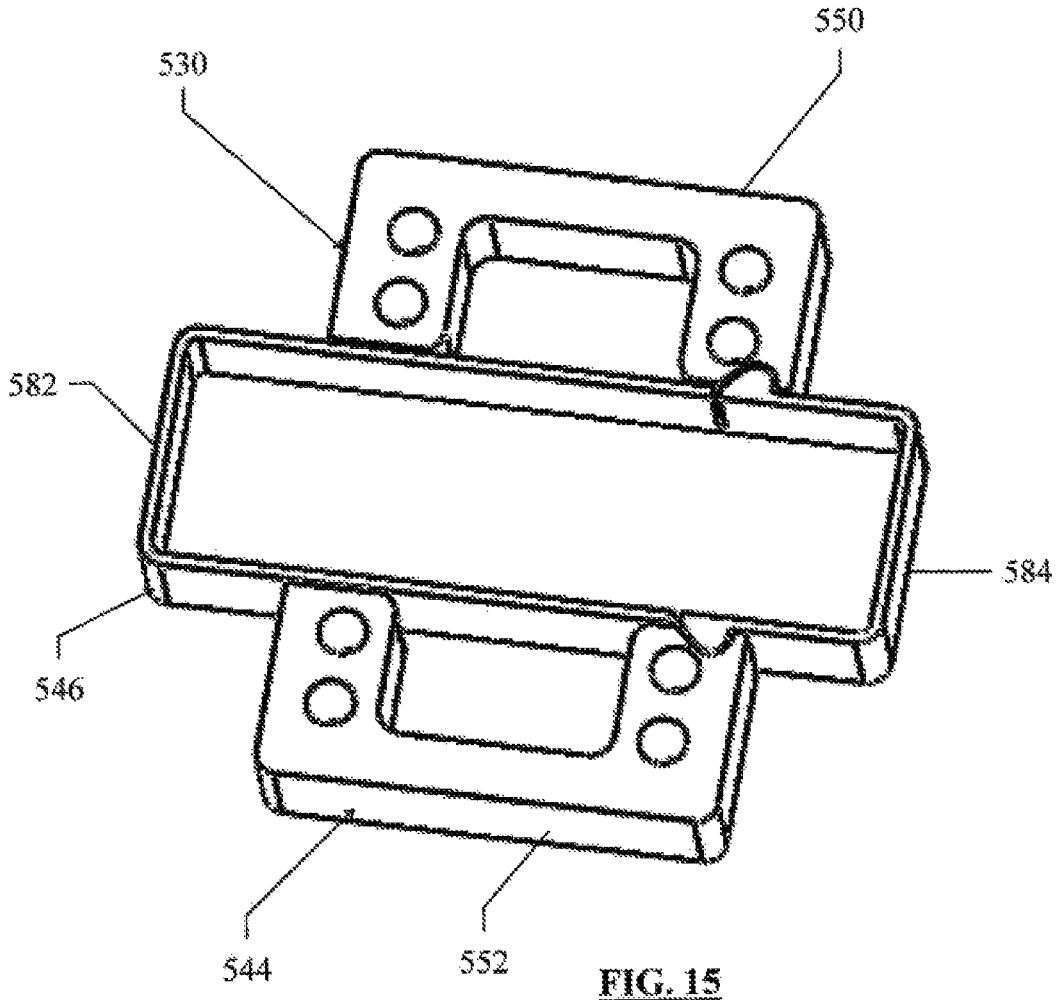
FIG. 15 is a perspective side view of an exemplary third embodiment of a concealed compartment system for use with a skateboard constructed in accordance with the principles of the present invention.

Referring now to FIG. 15, a third embodiment of the concealed compartment system, generally designated 530, is illustrated, wherein like components are numbered alike. In this exemplary embodiment, the cross beam 54 from the first embodiment 30 has been eliminated and the opposing rails 550, 552 of the rail body 544 are spaced apart and not connected. In this configuration, the inner end 582 of the cartridge insert 546 extends beyond the rails 550, 552 similar to the extension of the opposing outer end 584. Such construction allows for more customized placement of the rails and/or longer rail lengths since there is not width limiting cross beam. The cartridge insert 546 must be sized accordingly with the spacing of the spaced apart rails on the bottom surface of the skateboard deck so that the bosses engage the catch recesses, as with the first embodiment 30 discussed above. Overall, the operation of this concealed compartment system 530 is similar the prior embodiments discussed above as well.

Figure 16:
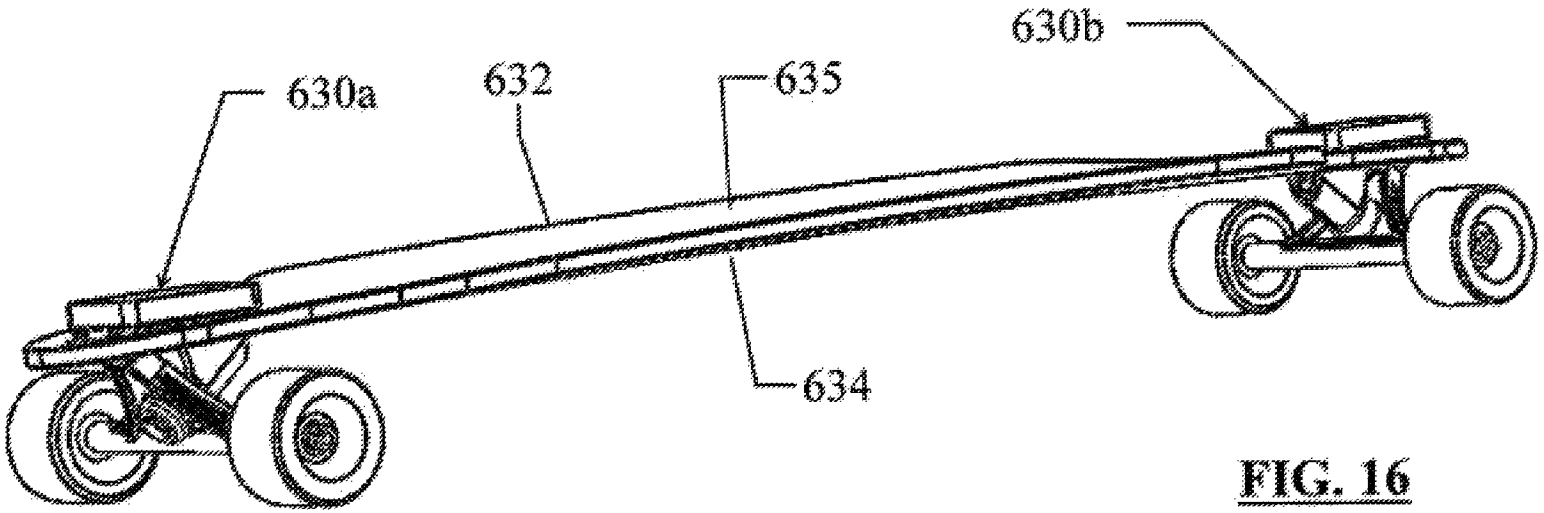
FIG. 16 is an upper perspective view of an exemplary fourth embodiment of a concealed compartment system for use with a drop through skateboard deck constructed in accordance with the principles of the present invention.
Figure 17:
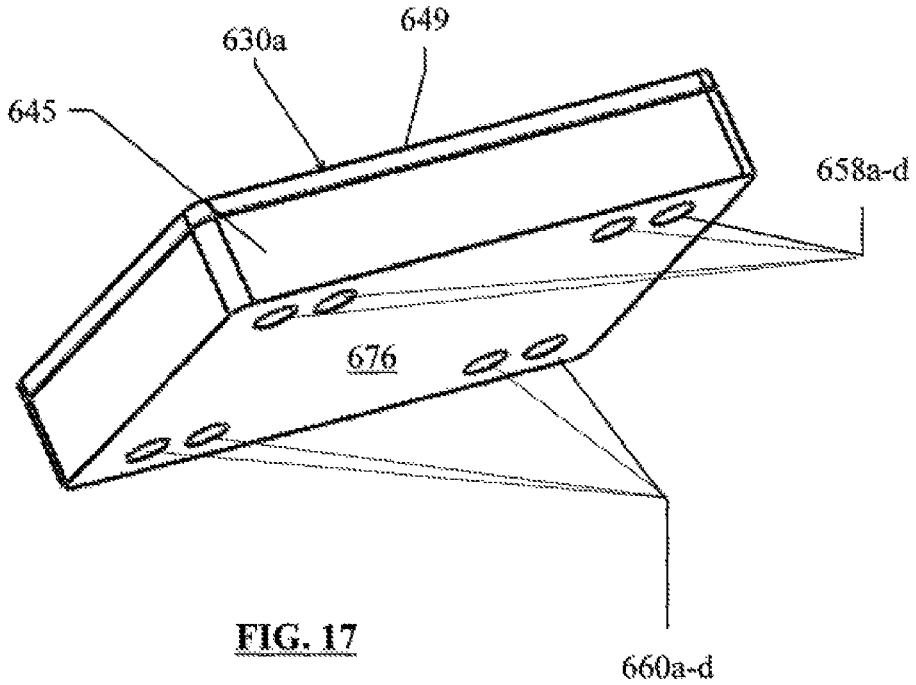
FIG. 17 is a bottom perspective side view of the concealed compartment system without the skateboard deck.
Figure 18:
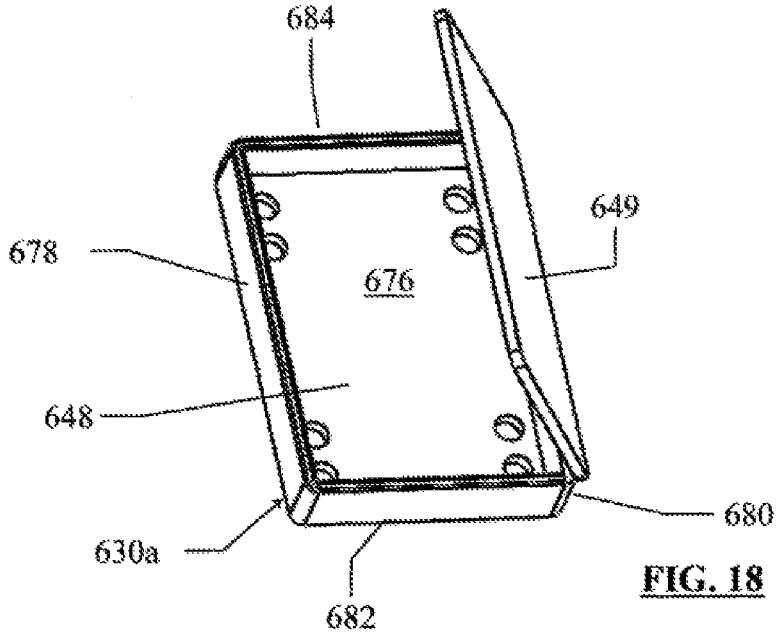
FIG. 18 is an upper perspective view of the concealed compartment system of FIG. 17, in reduced scale.

Turning now to FIGS. 16-18, a fourth embodiment of the concealed compartment system, generally designated 630*a*, 630*b*, is illustrated, wherein like components are numbered alike. In this exemplary embodiment, the concealed compartment system is constructed for use with a drop through style skateboard deck 623 as illustrated, for example, in FIG. 16. As will be understood by one of ordinary skill in the art, such drop through decks have a pair of front and rear apertures projecting from the bottom surface 634 to the top surface 635 to enable a set of trucks to be "dropped through" the top surface of the deck such that the top surface of each truck is exposed on the top surface of the deck while resting on a surrounding ledge or lip projecting into the apertures. The surrounding ledge includes the bolt holes for securing the trucks to the deck. The trucks are then secured to a surrounding ledge or lip projecting into the apertures. When installed, the top surface of each truck may either be flush with the upper deck surface, project above the surface, or be recessed below the surface. Such drop through construction may be used to facilitate a lower overall profile of the truck and deck assembly.

In this exemplary concealed compartment system embodiment 630*a*, for example, the cartridge insert and rail body have been modified into a single integrated unit. The bottom surface 676 of the concealed compartment system 630*a* is generally planar but incorporates the bolt holes 658*a-d* and 660*a-d* similar to those provided in the rail body 44 (FIG. 4) as well as forming the bottom surface of the compartment 648. The opposing surface 649 is a lid hingedly connected to a sidewall 680 of the concealed compartment system 630*a* and closes off the compartment when the lid is closed and provides access to the compartment when the lid is opened.

To install this concealed compartment system embodiment 630*a*, the user may open the lid 649 to expose the bolt holes. The truck bolts may be passed through the bolt holes 658*a-d* and 660*a-d* as selected by the user to align with the truck mounting holes pre-formed in the drop through deck and secure conventionally. At this point, the truck is secured to the deck and the concealed compartment system with the lid in an uppermost position. The user may then store items in the compartment 648 and close the lid to store the items. When the items are needed, the lid may simply be opened to procure the items.

The lid 649 may be hingedly attached to the main body 645 of the concealed compartment system 630*a* or otherwise secured using magnetic fasteners, snaps, buttons, straps, bayonet clips, clips, hook and loop closures, zippers, or other suitable fastener. Instead of a lid, a sliding drawer may also be used. In addition, the profile of the concealed compartment system may be constructed to appear flush or recessed from the upper deck surface and covered with a decal, plug, label, or other temporary covering to further conceal the concealed compartment system.

Figure 19:
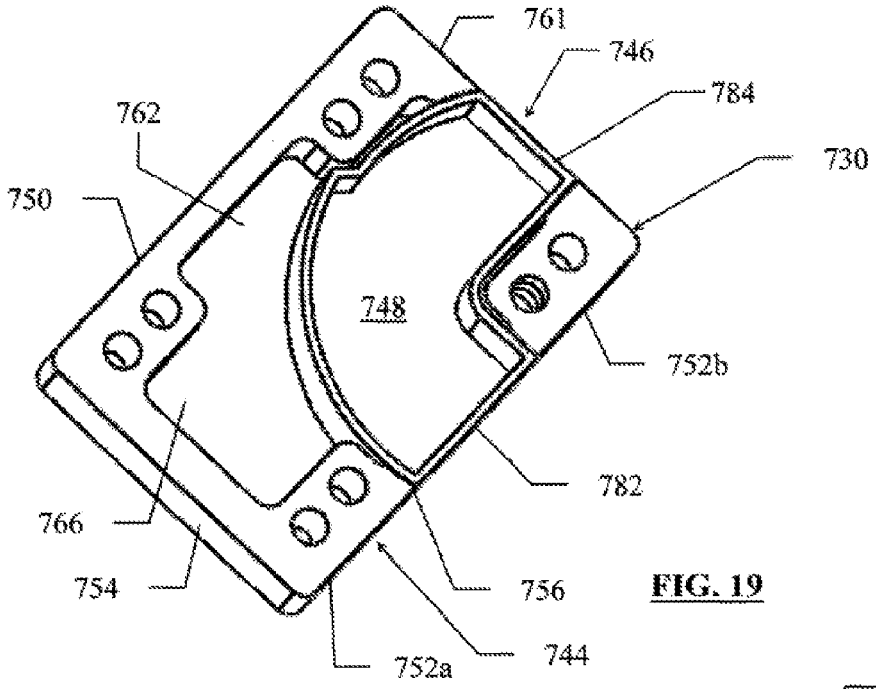
FIG. 19 is an upper perspective view of an exemplary fifth embodiment of a concealed compartment system for use with a skateboard constructed in accordance with the principles of the present invention.
Figure 20:
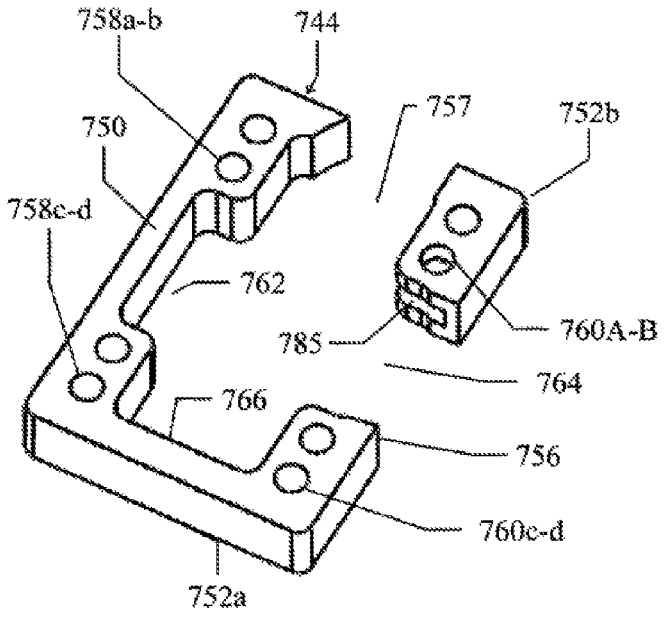
FIG. 20 is a similar view to that of FIG. 19, in reduced scale, with the drawer removed.
Figure 21:
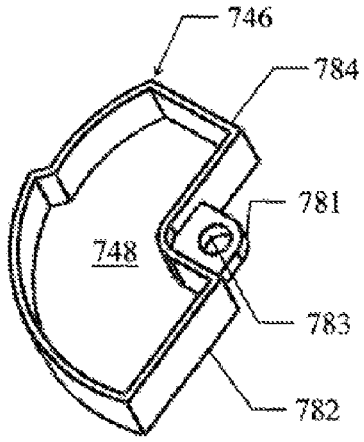
FIG. 21 is a similar view to that of FIG. 19, in reduced scale, with the rails removed.

A fifth embodiment of the concealed compartment system, generally designated 730, is illustrated in FIGS. 19-21, wherein like components are numbered alike. The rail body 744 has been modified to accommodate a pivoting cartridge insert 746. The rail body includes a first rail 750 and an opposing second rail 752*a*, 752*b* with a central recess 764 that extends through the side wall of the second rail to form a side opening 756 in the rail body 744 that receives the end wall 782 of the cartridge insert 746 when fully inserted into the rail body. The outer surface of the end wall 782 of the cartridge insert is flush with the outer surface of the adjacent rail 752*a*, 752*b* when the cartridge is held in a releasably engaged position. A secondary opening 757 on the outer end wall 761 of the rail body receives the end wall 784. The outer surface of the end wall 784 is flush with the surrounding outer surface 761 of the rail body when the cartridge is held in a releasably engaged position. The cartridge insert 746 is pivotally connected to the rail body 744 by a tab 781 with a slot 783 that engages a slotted fork section 785 in the second rail 752*b*. Alternatively, the cartridge insert may simply be held in place by a friction or interference fit or snapped into place as with the first embodiment.

The rail body 744 may secured to the bottom surface of the deck between the truck and deck as described above using aligned bolt holes 758*a-d* and 760*a-d* and corresponding truck mounting bolts to secure the rail body 744 between the truck mount upper surface and lower surface of the skateboard deck. It will be appreciated that the sections 752*a*, 752*b* may be connected together using a thin plastic strip or top wall that connects the two pieces together or completely separate altogether without interfering with the operation of the cartridge insert 746. Prior installing the separate section 752*b* of the second rail, the cartridge insert 746 is pushed into place and aligned with the end walls 784, 782 aligned with the openings 757, 764 respectively. Then the user may slid the second rail portion 752*b* into place by aligning the fork section 785 to slide over the tab 781 such that the slot 783 is aligned with the corresponding bolt hole. When the truck is secured in place, one of the bolts will pass through the tab slot 783 and fork to pivotally secure the cartridge insert 746.

To open the storage compartment 748, the user may push a finger against the end wall 784 of the cartridge insert 746 to pivot the cartridge insert relative to the rail body 744 so that the outer end 782 penetrates the second rail opening 756 and exposes the storage chamber 748. The cartridge insert may be completely removed from the rail body, items placed inside or retrieved and returned to its placement within the rail body. The user may simply insert the end 784 through the slot 756 and push and pivot the outer end 782 back toward the rail body to reengage the bosses and catch releases to releasably lock the cartridge insert to the rail body to form the concealed compartment 748. It will be appreciated that a cartridge insert that is pivotally secured by a truck bolt must be mounted with the drawer opening facing downwardly in order to store and retrieve contents as the opening clears the adjacent truck when pivoted. If the drawer is not pivotally secured by a truck bolt, then it may installed face up or down as the drawer is completely removable.

Figure 22:
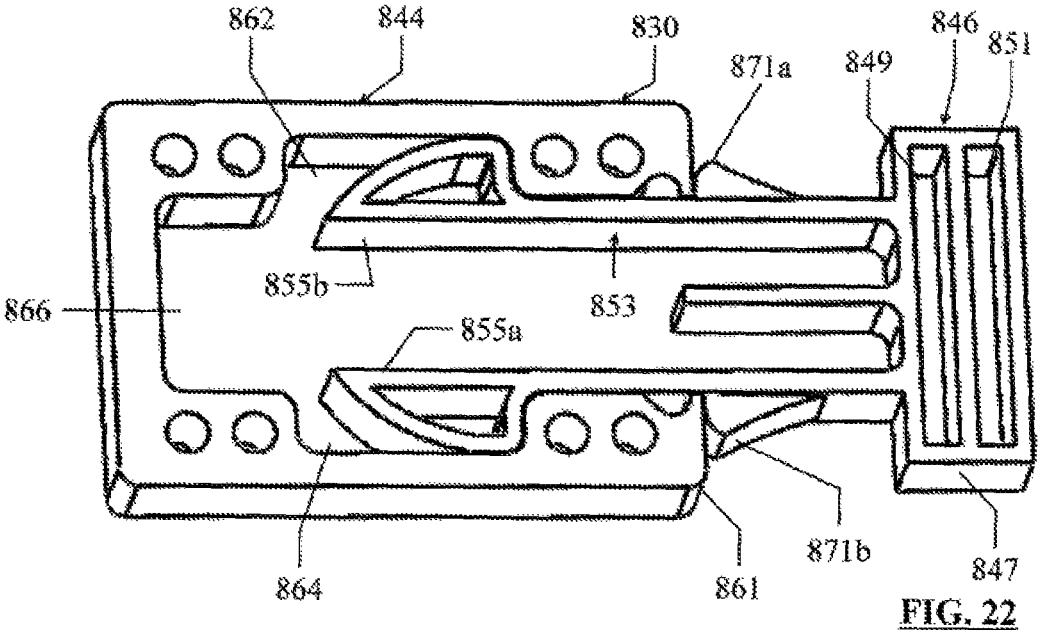
FIG. 22 is an upper perspective view of an exemplary sixth embodiment of a concealed compartment system providing clips for securing a carrying strap for use with a skateboard constructed in accordance with the principles of the present invention.
Figure 23:
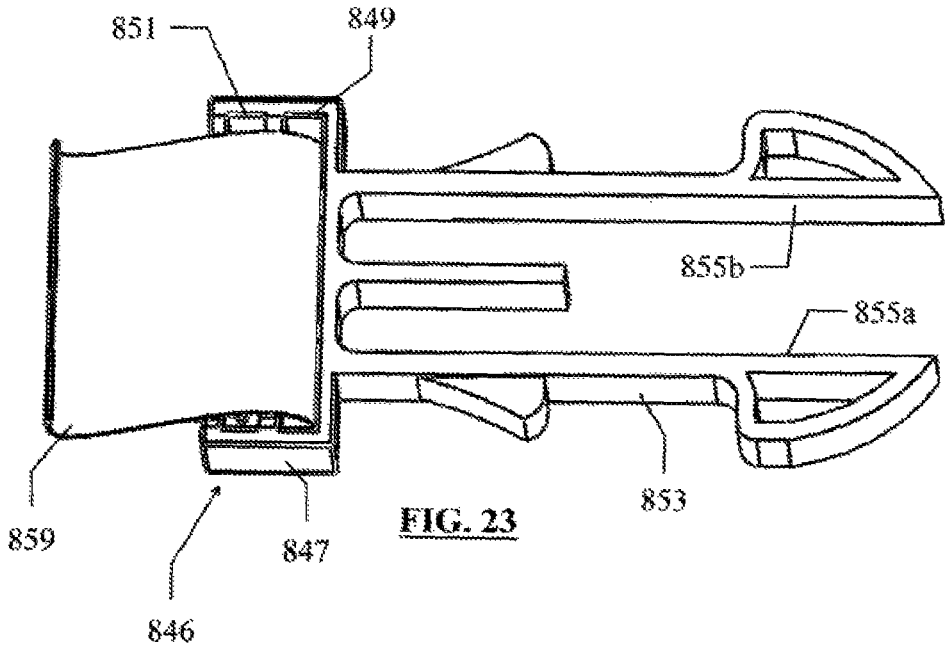
FIG. 23 is a reversed view of FIG. 22 with the rails removed.

Turning now to FIGS. 22-23, a sixth embodiment of the concealed compartment system, generally designated 830, is illustrated, wherein like components are numbered alike. In this exemplary embodiment, the cartridge insert 846 includes a modified outer section 847 with a set of passthrough slots 849, 851 for receiving a portion of a strap 859, tether, cable, or a chain. The interior end 853 of the cartridge insert includes a set of opposing bayonet fasteners 855*a*, 855*b* that may engage the opposing rail body bayonet catch recesses 862, 864. In use, the user may secure a pair of the concealed compartment systems 830 to each truck. Items may be stored between bayonet fasteners when installed into the rail body 844. Opposing ends of a strap may be looped through each set of passthrough slots. When installed, the strap would be maintained in low profile so as not to interfere with the riding experience. If the user wants to secure the skateboard, one cartridge insert may be removed, the strap and cartridge insert looped around a fixed object such as a bike rack, and then the cartridge insert reinserted to form temporary security latch. In addition, with both cartridge inserts installed and a strap between, the strap may be used as a handle for carrying the skateboard. The user may also store and retrieve items disposed between the bayonet fasteners within the rail body. A pair of squeezing bosses 871*a*, 871*b* extending from the intermediate section of the cartridge insert and abutting the outer end 861 of the rail body may be used to facilitate squeezing the bayonet fasteners inwardly to disengage the rail body when withdrawing the cartridge insert. It will be appreciated that one of the cartridges with one end of the strap may also be fixed to the rail body or one end of the strap fixed directly to the rail body. The strap ends may also be locked to the rail bodies using a key and lock combination or other locking mechanism. The strap may also double back onto itself to form a loop with its opposite end connected to the same rail body or cartridge insert. In such scenario, one concealment system may provide a locking unit while the other concealment system, if used, provides an interchangeable storage cartridge.

Figure 25:
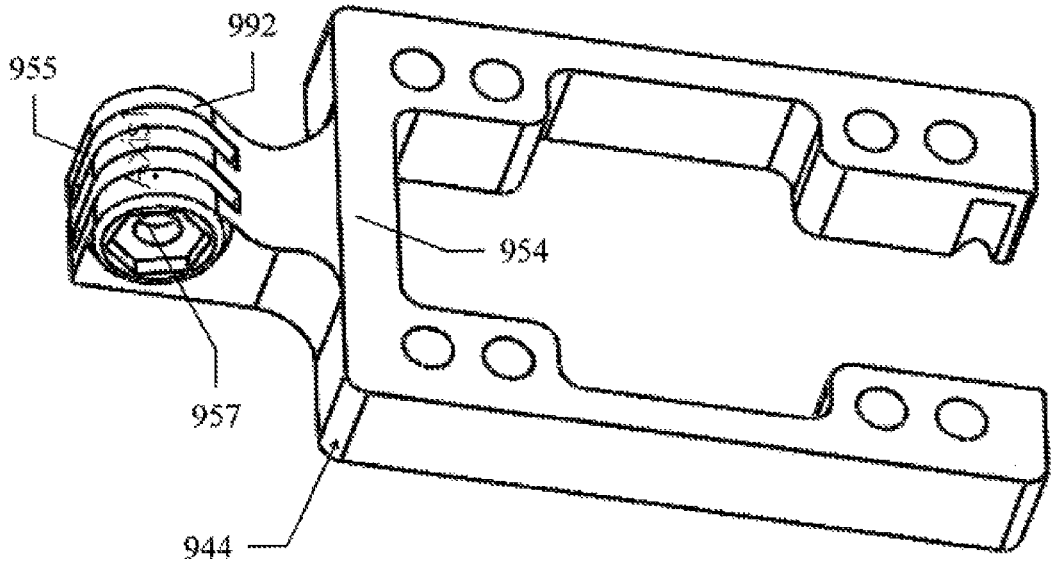
FIG. 25 is an upper perspective view of the rails of an exemplary seventh embodiment of a concealed compartment system providing a camera mount for use with a skateboard constructed in accordance with the principles of the present invention.
Figure 26:
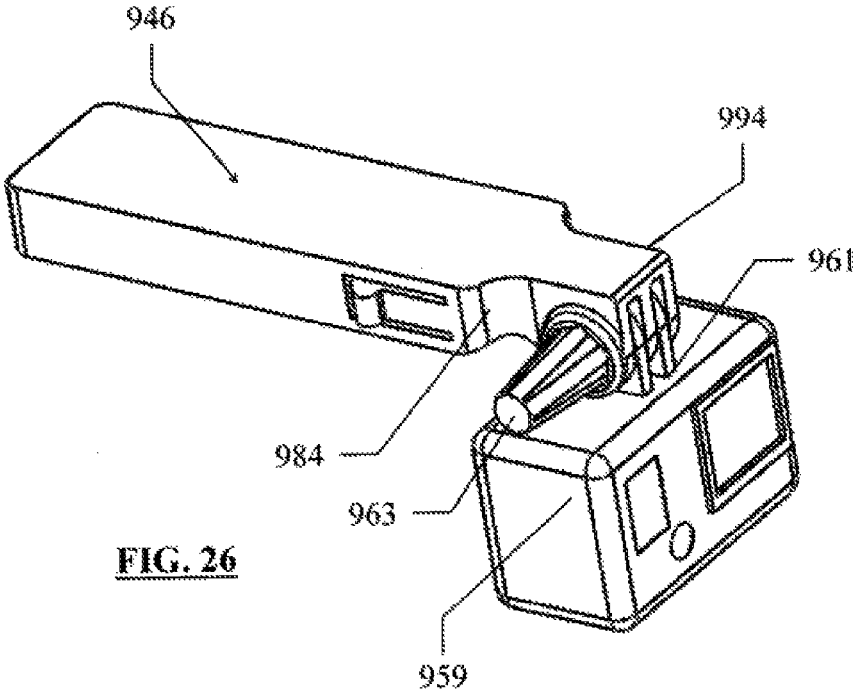
FIG. 26 is an upper perspective view of a drawer insert for use with the rails of FIG. 25.

A seventh embodiment of the concealed compartment system, generally designated 930, is shown in FIGS. 25-26. In this embodiment, the rail body 944 and cartridge insert 946 have both been modified to include a camera mount 992, 994, respectively, with the remaining structure remaining the same as with the embodiment in FIGS. 1-6. The camera mount 992 for the rail body extends outwardly from the end wall 954 and includes a fork 955 and throughbore 957 for mounting a camera, such as a GoPro brand camera, schematically represented as 959 with camera mount 961 and fastening bolt 963. Similarly, the camera mount 994 of the cartridge insert extends outwardly from the end wall 984 and replaces the grasping surfaces 92, 94 of the first embodiment 30*a*, 30*b*, while retaining the same functionality in addition to the camera mount. The cartridge insert camera mount is constructed similarly to the rail body camera mount. This configuration allows the user to mount a camera, such as a GoPro brand camera to the undersurface of the skateboard to video the riding experience. Given the option of forward and rear facing camera mounts, the user may opt for a forward facing or rear facing camera or both. Securing the camera to the camera mount will be understood by one of ordinary skill in the art. The camera may be connected to a charging unit as described herein that is stored in the concealed compartment system. The remaining construction, installation, and use of the rail body 944 and cartridge insert 946 is similar to the embodiment 30*a*, 30*b* of FIGS. 1-7.

Figure 27:
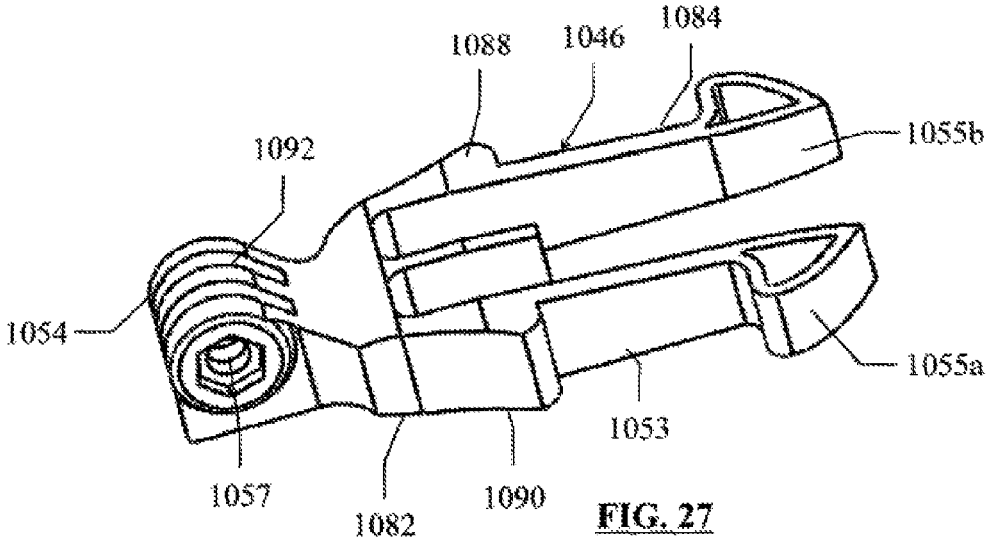
FIG. 27 is an upper perspective of an exemplary eighth embodiment of a concealed compartment system for use with a skateboard constructed in accordance with the principles of the present invention with the rail body removed.

An eighth embodiment of the concealed compartment system having a cartridge insert, generally designated 1046 (FIG. 27) and a corresponding spaced apart rail body generally designated 1044 (FIG. 28) is illustrated combining the bayonet cartridge and camera mount features or prior embodiments (for example, from FIGS. 22-23 and FIGS. 25-26). Referring to FIG. 27, the cartridge insert 1046 includes a first end 1082 adjacent a clip end 1084 with a camera mount 1092 with a fork 1054 and a throughbore 1057 extending from the first end 1082 for mounting a camera as described above. The clip end 1084 includes spaced apart flexible but resilient bayonet prongs 1055*a*, 1055*b* similar to the construction of the bayonet clips in FIGS. 22-23. Spaced between the bayonet prongs 1055*a*, 1055*b* and the first end 1082 of the cartridge insert 1046 is a pair of opposing bosses 1088, 1090 to engage with corresponding catch recesses in the rail body 1044 as described below.

Figure 28:
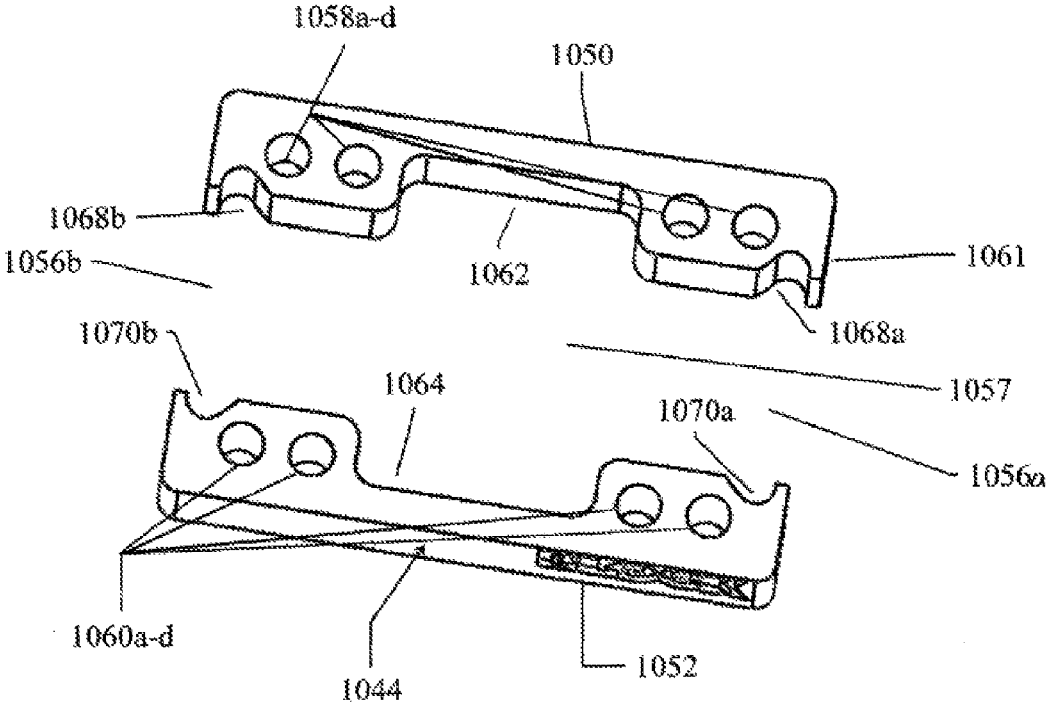
FIG. 28 is an upper perspective of an exemplary eighth embodiment of a concealed compartment system for use with a skateboard constructed in accordance with the principles of the present invention with the cartridge insert of FIG. 27 removed.

Turning now to FIG. 28, the rail body 1044 includes a first rail 1050 spaced apart from a second rail 1052 with each rail incorporating a bayonet prong catch recess 1062, 1064, respectively (similar to that of FIG. 22). Each rail 1050, 1052 further includes a set of bolt holes 1058*a-d* and 1060*a-d*, respectively, for mounting the rail body between the truck and skateboard deck. The spacing of the rails 1050, 1052 when mounted creates a central channel 1057 with a mouth 1056*a*, 1056*b* at either end. In addition, each rail 1050, 1052 has opposing and aligned front and rear catch recesses 1068*a*, 1068*b* and 1070*a*, 1070*b*, respectively. It will be appreciated that the location of the front and rear catch recesses and central location of the bayonet catch recesses 1062, 1064 enable the user to slide the cartridge insert 1046 (FIG. 27) in to the rail body 1046 through either mouth 1056*a*, 1056*b* and into the central channel 1057 to releasably secure the cartridge insert 1046 with the rail body

1044. This facilitates mounting a camera on the front or rear end of the installed concealed compartment system. While the open end rail body configuration and open end cartridge insert does not provide a fully enclosed compartment when installed, a user may still access the spaced formed between the bayonet prongs 1055*a*, 1055*b*, the first end 1082, the bottom surface 34 of the deck 36, and top surface of the truck to store items using a friction fit. Alternatively, another cartridge insert as described herein may be inserted between the bayonet prongs or a door or other sealable wall like a plug may be inserted between the bayonet prongs to seal off the opening to form an enclosed concealed compartment.

Figure 29:
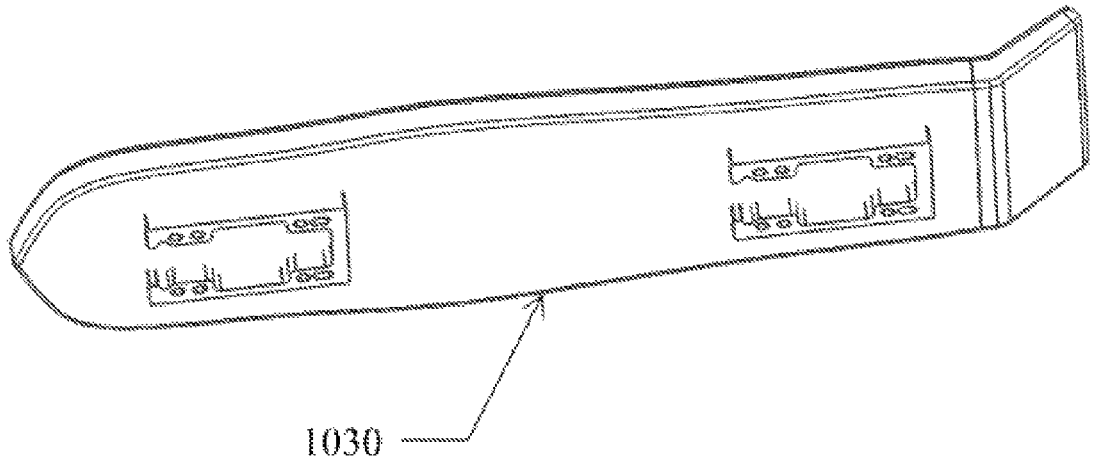
FIG. 29 is a bottom perspective of another embodiment of a concealed compartment system illustrating rail body molded into a skateboard deck.
Figure 30:
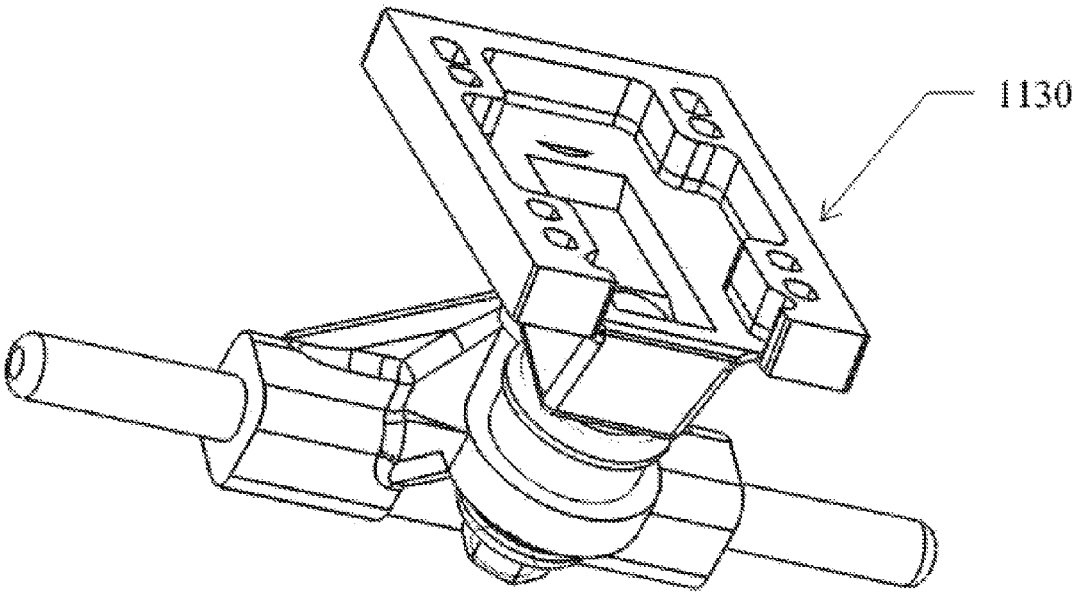
FIG. 30 is a top perspective of an another embodiment of a concealed compartment system illustrating a truck with a rail body cast or machined into the base plate.
Figure 31:
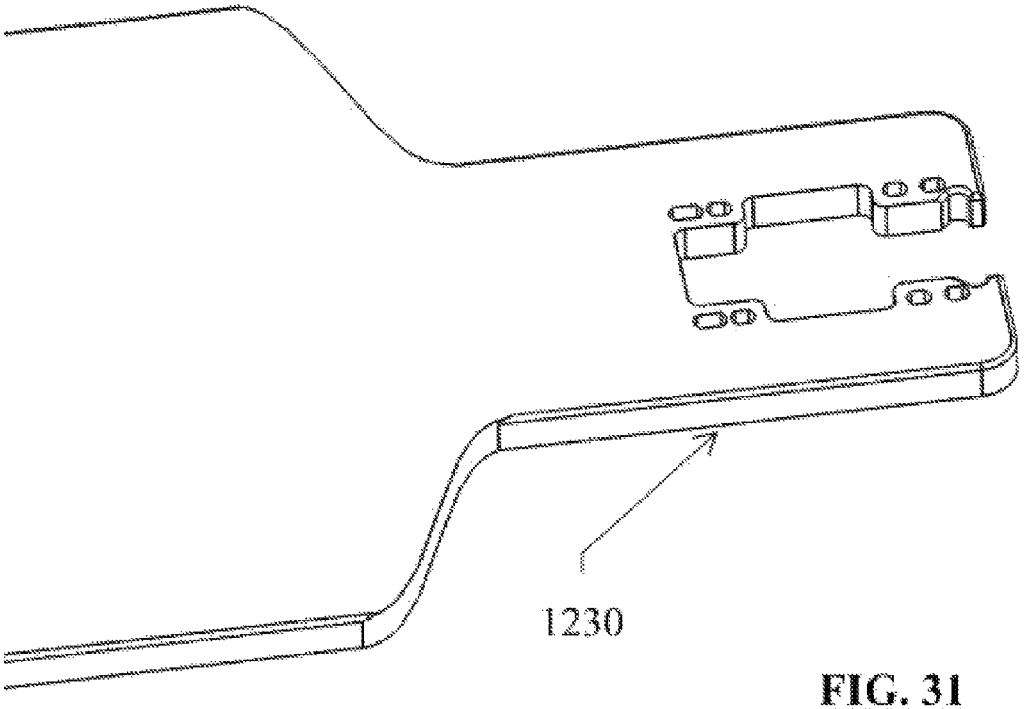
FIG. 31 is a bottom perspective of yet another embodiment of a concealed compartment system illustrating a skateboard deck with a rail body within the deck itself.

It will be appreciated that the risers described herein may be molded into or as part of the skateboard deck, constructed as part of the truck, or formed directly into deck during the deck construction process. For example, FIG. 29 shows one such embodiment, generally designated 1030, of a skateboard deck with a rail body molded therein. FIG. 30 illustrates a truck, generally designated 1130, with a base plate having a cast or machined rail body. FIG. 31 illustrates a skateboard deck, generally designated 1230, having a rail body formed directly into a skateboard deck. While this configuration shown in FIG. 31 does compromise the deck structure somewhat by forming a hole in the deck and is not preferred, this configuration remains within the scope of the invention.

While the foregoing concealed compartment systems describe opposing boss/catch recess releaseable engagements between the cartridge insert and rail body, other suitable releasable engagements may be used including but not limited to, a simple friction fit, a single catch, other interference fits, a bayonet fitting, a strap, tie, hook, magnets, or hook and loop construction. In addition, examples of securing cartridge inserts using internal catches and recesses have been described herein. However, external catches and recesses, or a combination of both internal and external catches and engagements, may also be used to releasably secure the cartridge insert to the rail body. For example, the catch recesses of the rail body may project outwardly for engagement with inwardly facing cartridge insert bosses sized to engage the rail body. A clam shell style concealed compartment system with pivoting cartridge insert and rail body is another suitable device for storage items between the truck and skateboard deck or above the truck. Other suitable releasable engagements will occur to one of ordinary skill in the art.

It will also be appreciated that the various cartridges and inserts may be constructed to be interchangeable to suit the riding experience. For example, if riding at night, the LED insert may be more useful. On the other hand, the tool kit insert may be more useful if the rider will be a long way from a repair center.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. Any dimensions provided herein are exemplary and not meant to be limiting in any manner.

It is also contemplated that various combinations or sub-combinations of the specific features and aspects of the embodiments may be made and still fall within the scope of the invention. Accordingly, it should be understood that various features and aspects of the disclosed embodiments may be combined with or substituted for one another in order to form varying modes of the disclosed invention. As one, non-limiting example, the cartridge inserts may generally be used with the closed or open ended rail bodies. Thus, it is intended that the scope of the present invention herein disclosed should not be limited by the particular disclosed embodiments described above.

What is claimed is:

1. A concealed compartment system for a skateboard having a skateboard deck and at least one truck, the system comprising:

a riser having a rail body with a deck mounting surface and a truck mounting surface, the riser being constructed to be at least partially interposed between the skateboard deck and the at least one truck while releasably securing the at least one truck to the skateboard deck, the riser further including a channel projecting at least partially through the rail body; and a storage chamber at least partially projecting through the channel of the rail body for storing one or more items, the storage chamber having a concealed opening through which the one or more items may be inserted or retrieved.

2. The concealed compartment system as set forth in claim 1 wherein:

the storage chamber is a removable drawer constructed to assume a first position in which concealed opening of the storage chamber is closed off by a surface of the deck and a second position in which the drawer is removed at least partially from the channel from which one or more items in the storage chamber may be loaded or retrieved through the concealed opening.

3. The concealed compartment system as set forth in claim 1 further including:

a set of wheels rotatably mounted to the at least one truck mounted on the skateboard with the rail body interposed therebetween;

a camera mount projecting from at least one end of the rail body or storage chamber; and a camera releasably secured to the camera mount and positioned above the lowermost extent of the set of wheels rotatably mounted to the at least one truck.

4. The concealed compartment system as set forth in claim 1 wherein:

the storage chamber includes an LED operable to cast light in the direction of travel.

5. The concealed compartment system as set forth in claim 1 wherein:

the storage chamber includes a multi-tool kit.

6. The concealed Compartment system as set forth in claim 1 wherein:

the channel includes a first opening and a second opening; and the storage chamber is pivotally secured to the rail body and constructed to be accessible through either opening.

7. The concealed compartment system as set forth in claim 1 further including:

a battery charger within the storage chamber.

8. The concealed compartment system as set forth in claim 1 further including:

a battery charger with a USB port within the storage chamber.

9. The concealed compartment system as set forth in claim 1 further including:

a GPS unit within the storage chamber.

10. The concealed compartment system as set forth in claim 1 wherein:

the rail body includes at least two spaced apart rails releasably securing the storage chamber.

11. The concealed compartment system as set forth in claim 1 wherein:

the rail body includes a side profile with a first planar surface and an opposing intersecting surface; and the storage chamber is constructed with a complementary side profile.

12. The concealed compartment system as set forth in claim 1 wherein:

the rail body includes a pair of opposing rails with the storage chamber at least partially inserted between the opposing rails; and at least one locking boss and a correspondingly aligned locking notch constructed to removably secure the storage chamber to the rail body.

13. The concealed compartment system as set forth in claim 1 wherein:

the concealed opening of the storage chamber is covered by a flip open lid.

14. The concealed compartment system as set forth in claim 1 further including:

a skateboard deck;

a front truck with a set of front wheels;

a rear truck with a set of rear wheels;

a first fastener secured to the rail body coupled to one of the trucks; and a tethering member coupled to the first fastener; and a second fastener also coupled to the tethering member and releasably connected to the other truck, the second fastener being constructed to disengage from the other truck, allow the tethering member to engage with a fixed object, and to reengage with the other truck to inhibit the skateboard deck from being removed from the fixed object due to interference from the tethering member.

15. A concealed compartment system for use with a skateboard comprising:

a riser having a block body with a deck mounting surface and a truck mounting surface, the riser being at least partially interposed between the skateboard deck and at least one truck while releasably securing the truck to the skateboard deck when the deck, truck, and riser are assembled together, the block body further including a pair of opposing rails forming a slot projecting at least partially therethrough; and an interchangeable storage cartridge at least partially projecting through the slot in the block body, the storage cartridge including a storage chamber constructed with at least one opening through one or more items may be inserted, the cartridge further being constructed to slidably engage the rails and move between a first position in which the storage cartridge is removably secured to the rails with the opening sealed off by the deck and a second position in which the storage cartridge may be at least partially removed from the slot and from which the one or more items may be loaded or retrieved through the opening.

16. The concealed compartment system as set forth in claim 15 wherein:

the storage cartridge includes a first locking element;

at least one rail includes a second complementary locking element wherein the storage cartridge may be releasably locked to the at least one rail of the block body.

17. The concealed compartment system as set forth in claim 15 wherein:

the storage cartridge includes at least one end extending into a camera mount.

18. A concealed compartment system for use with a skateboard comprising:

a skateboard deck;

a riser projecting from the deck and providing a spacer between the deck and at least one truck secured to the deck, the riser further including at least one channel projecting at least partially through the riser;

a drawer having a drawer body at least partially inserted into the channel, the drawer including a storage chamber with an opening facing the deck, the drawer being constructed to assume a first position in which the storage chamber is closed off by the lower surface of the deck and a second position in which the drawer is removed sufficiently from the channel to allow one or more items to be loaded or retrieved through the opening; and a releasable locking element with a first locking member and a complementary second locking member with the locking members constructed to cooperate to releasably secure the drawer to the riser in a locked and concealed position and slidably disengage the drawer from the riser to an unlocked and open position.

* * * * *